United States Patent [19]

Sussman et al.

[11] Patent Number: 4,735,317

[45] Date of Patent: Apr. 5, 1988

[54] SELF SEALING DISPENSER PACK FOR PRE-MOISTENED TOWELETTES

[75] Inventors: Charles M. Sussman, Ridgefield; William T. McTiernan, Washington Depot, both of Conn.

[73] Assignee: Nordic Industries, Inc., Marbledale, Conn.

[21] Appl. No.: 919,130

[22] Filed: Oct. 15, 1986

[51] Int. Cl.[4] ..... B65D 85/67

[52] U.S. Cl. ..... 206/449; 206/494; 206/812; 206/815; 221/46; 221/63; 248/205.3

[58] Field of Search ..... 206/233, 235, 409, 494, 206/581, 812, 815, 449; 220/306; 221/63, 45, 46; 248/205.3

[56] References Cited

U.S. PATENT DOCUMENTS

| | | | |
|---|---|---|---|
| 3,207,566 | 9/1965 | Grieco et al. | 248/205.3 |
| 3,383,012 | 5/1968 | Adell | 221/63 |
| 3,819,043 | 6/1974 | Harrison . | |
| 3,967,756 | 7/1976 | Barish | 221/45 |
| 3,982,659 | 9/1976 | Ross | 221/63 |
| 3,986,479 | 10/1976 | Bonk | 221/63 |
| 4,000,816 | 1/1977 | Spruyt . | |
| 4,131,195 | 12/1978 | Worrell, Sr. . | |
| 4,138,034 | 2/1979 | McCarthy | 221/63 |
| 4,143,762 | 3/1979 | Spiegelberg . | |
| 4,181,225 | 1/1980 | Spiegelberg . | |
| 4,192,420 | 3/1980 | Worrell, Sr. et al. . | |
| 4,420,080 | 12/1983 | Nakamura . | |
| 4,428,477 | 1/1984 | Cristofolo . | |
| 4,431,114 | 2/1984 | Kleinfeld | 220/306 |
| 4,462,507 | 7/1984 | Margulies | 206/409 |

FOREIGN PATENT DOCUMENTS

| | | | |
|---|---|---|---|
| 1177785 | 11/1984 | Canada | 206/812 |

*Primary Examiner*—Jimmy G. Foster
*Attorney, Agent, or Firm*—Thomas A. Beck

[57] ABSTRACT

A dispenser providing access to a plurality of pre-moistened towelettes and having dual orifices covered by a self sealing lid. A larger recessed orifice in the top side of the container accommodates a smaller opening and both openings are covered by a lid attached to a ledge surrounding the larger recessed orifice perimeter. The lid has approximately the same planar dimensions as the combination planar dimensions of the recess and ledge and is held in a closed position by press fitting under an outer border curbing the perimeter of the outermost edge of the ledge. A removable back panel is provided for ease of refilling prepackaged towelettes in the dispenser, and a second back attachment means is provided for attaching or mounting the dispenser to a flat surface.

9 Claims, 2 Drawing Sheets

SELF SEALING DISPENSER PACK FOR PRE-MOISTENED TOWELETTES

FIELD OF THE INVENTION

This invention relates to a dispenser for pre-moistened towelettes having, in particular, a dual orifice with a self sealing lid that forms a part of the container.

BACKGROUND OF THE INVENTION

In the art of dispenser packaging, containers with resealable lids for maintaining moistened tissues are well known. The most frequently observed containers of this type contain a plurality of pre-moistened tissues stacked within the container or package. Access to the towelettes is usually achieved through a symmetrical opening in a top side of the container which is resealed by a flap extending directly over and beyond all sides of the opening.

An example of such dispenser construction is disclosed in U.S. Pat. No. 3,819,043-Harrison. The dispenser pack has an opening in a top side of the container covered by a flap which may have a depression molded onto its bottom side having the same shape as the opening. The flap self closes when allowed to return to a horizontal position and the optional depression protrudes into the opening to further tighten the seal.

Further examples of access openings covered directly by extended flaps are shown in U.S. Pat. Nos. 4,420,080; 4,143,762; and 4,131,195.

Problems associated with these dispenser constructions are the immediate exposure of the towelettes to moisture loss when the flap seal is left open or fails and soiling of the towelettes during opening and closing of the flap.

The present invention with dual orifices covered by a self sealing flap represents an improved means of closing dispenser packs. The invention presents further improvements over prior art dispensers such as a removable bottom side facilitating easy refill of the towelette packages while reducing moisture loss and an additional back panel which may have an adhesion or mechanical means for attaching the dispenser to a flat surface.

SUMMARY OF THE INVENTION

In its broadest aspects this invention provides a molded plastic container having a top side with dual orifices covered by a self sealing lid and a removable bottom side which may be further provided with an attachment panel.

One of the aforementioned orifices is a recess or cavity which accommodates a smaller opening at the bottom of the cavity. A self sealing lid is attached to one side of the cavity covering the entire cavity and sealing by its free end on the opposing side of the cavity.

In the preferred embodiment, a ledge surrounds the perimeter of the cavity in the dispenser's top side and has an outer border or riser wall extending inwardly and in a perpendicular direction relative to a horizontal axis of the cavity. This outer border or riser wall configuration provides a closure means by which the free ends of the flap are held in a closed position by press fitting the flap below the inward curve of the outer border. For convenience, the unsecured end of the flap is provided with a tab which extends into a thumb print-like impression along the riser wall and flush with the ledge and in the topside of the container and facilitates moving the flap to an open position.

The bottom side of the dispenser may be provided with an opening which will accommodate a finger and aid in its removal from the dispenser. Preferably, the bottom side press fits into a molded configuration of the bottom of the dispenser to form a part of it. Additionally, a slip-on panel attachment having an adhesive or mechanical means may be attached to the bottom side of the container so that the dispenser may be mounted or attached to a flat surface.

BRIEF DESCRIPTION OF THE DRAWINGS

For a better understanding of the invention, together with other and further objects thereof, reference is made to the following description, taken in connection with the accompanying drawings, and its scope will be pointed out in the appended claims.

Referring now to the drawings.

DETAILED DESCRIPTION OF THE INVENTION

Figure 1:
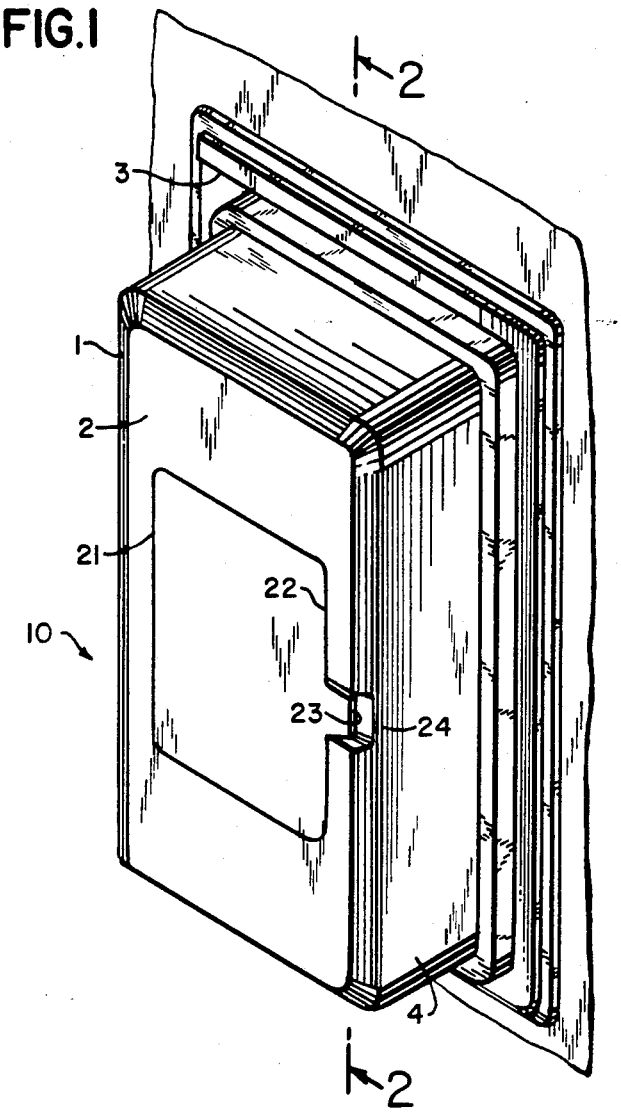
FIG. 1 is a perspective view of the dispenser illustrating the lid in a closed position.

The present invention 10 provides a container 1 for dispensing a packet 5 of pre-moistened towelettes or tissues 6 having a resealable lid 20 covering dual orifices cavity 12 and opening, 14 as shown in FIG. 1.

The container 1 is preferably molded of a resilient plastic and has a top 2, bottom 3 and sides 4. Although a plastic material is preferred because it is inexpensive and easy to mold, it may be appreciated that any material which is moisture resistant may be used to produce the dispenser.

Figure 2:
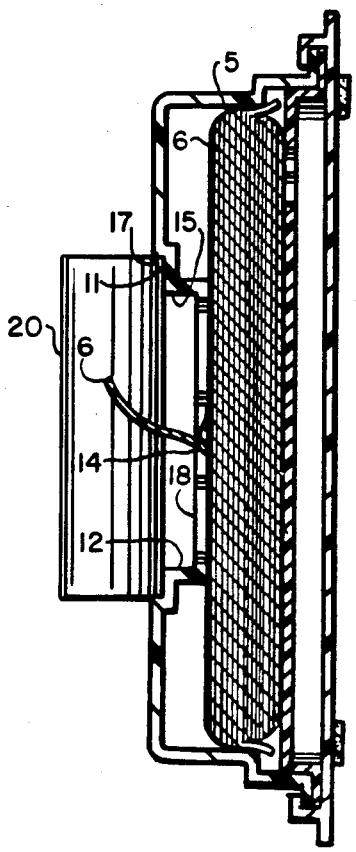
FIG. 2 is a cross-sectional view, taken along lines 2—2 of FIG. 1, illustrating the dual orifice and package of pre-moistened towelettes.

A plurality of towelettes 6 are preferably packaged in a flexible packet 5 for ease of refilling the container 1 as illustrated in FIG. 2. A preformed slit or cut 7 may be provided in one side of the package 5 for dispensing the towelettes 6. (See FIG. 3.)

The towelettes may be folded in any manner known in the art. For example, interfolded pop up or individually folded non-pop up towelettes with such folds configuration as C, J, S or Z may be used. The term "pop up" in reference to towelettes is a term of art referring to the fact that the trailing edge of a removed towelette causes the leading edge of a subsequent towelette to protrude through an opening for use. In the preferred embodiment, pop up towelettes are used, however, it may be appreciated that non-pop up towelettes may also be accomodated in the dispenser.

Access to the towelettes 6 in the dispenser 10 is gained through cavity 12 and opening, 14. The cavity 12 may be of any shape known in the art but preferably has a rectangular shape with the longer dimension parallel to the longer dimension of the preferably rectangular container 1. The cavity (12) is formed from a base wall (18) and peripheral walls (15), which peripheral walls extend from said base wall to said top of said container, said aforementioned base wall (18) having an opening (14) transversely positioned relative to a presented edge of the premoistened towelettes. In the preferred embodiment, the cavity 12 is recessed from the top 2 of the container 1 and has a ledge 11 and a corresponding riser wall (17) surrounding the perimeter 13 of the cavity 12 at substantially the same level in the dispenser top 2 as the peripheral walls 15 of the cavity 12. The width 16 of the ledge 11 is preferably less than ½" inches wide. It may be appreciated that the peripheral walls 15 of the cavity 12 may be flush with the top 2 of the container 1 in another embodiment.

Along an outermost edge of the ledge 11 away from the cavity, a riser wall 17 is preferably provided. The riser wall 17 surrounds the ledge 11 and extends inwardly and upwardly in a substantially perpendicular direction relative to an imaginary horizontal axis of the cavity 12. Preferably, the riser wall is approximately ¼" wide.

The smaller opening 14 may be of any shape known in the art but is preferably H-shaped and is provided in the base wall 18 of the cavity 12 with the longer dimensions of the letter configuration parallel to the longer sides of the cavity 12. Optionally, a plastic material sheet may horizontally traverse the opening 14 and attach to the bottom wall 18 of the cavity 12. This plastic sheet leaves an opening approximating a "U" shape permitting access to the towelette 6 and further preventing excess evaporation of moisture from the dispenser 10.

Towelettes 6 may be placed in the dispenser 10 with the edges 8, 9 parallel to the longer dimensions of the cavity 12 and opening, 14 with an exposed edge of a top towelette 6 protruding through both cavity 12, and opening 14. As a result of this presentation, one may tug the exposed edge of the towelette 6 to remove it through the opening (14) and cavity (12) from the dispenser 10 leaving a second exposed edge of the towelette immediately behind it and protruding through the opening (14) cavity 12, when a second tissue 6 is desired.

Access to the cavity 12 opening, 14 is gained through a resilient sheet lid 20 preferably made of a plastic material. The lid 20 may be rectangular in shape and have approximately the planar dimensions of both the recessed cavity 12 and the ledge 11 so as to fit within the area defined within riser walls (17). The lid 20 may be attached to the dispenser 1 by adhering a longitudinal edge 21 to a corresponding longitudinal edge of the ledge 11. Heat sealing is a preferred means of attaching the lid 20, although it may be appreciated that any means known in the art may be used depending on the selected dispenser material.

The diametrically opposing free end 22 of the lid 20 may be provided with a tab 23 accommodated in a thumb print-like impression 24 in the riser wall 17 between the top 2 and sides 4 of the container 1.

To self seal the lid 20, its free edge 22 may be lightly tapped, moving it below the inwardly curving top side of the riser wall 17 and holding it in a closed position. In this closed position, the tab 23 extends over the impression 24 and a finger may easily reach into the impression 24 to lift the tab 23 and open the lid 20.

Other closure means, such as Velcro® brand material, brackets, or any means known in the art may be used to more securely adhere the free end 22 of the lid 20 in a closed position. THe provision of the lid 20 closing the larger cavity 12, rather than the smaller opening 14 prevents excessive evaporation and soiling of the towelettes 6.

Figure 3:
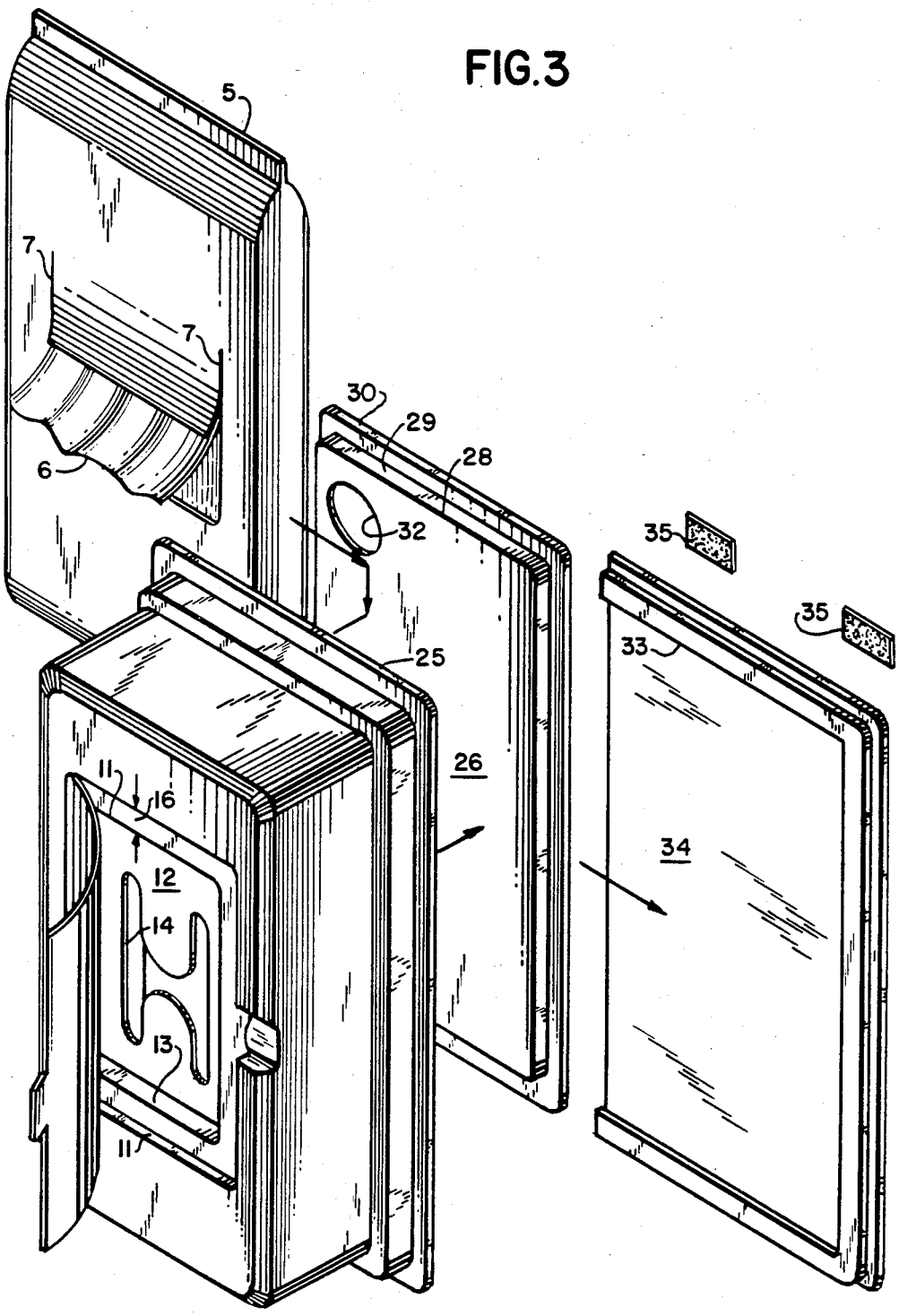
FIG. 3 is an exploded view of the dispenser illustrating its component parts.

As illustrated in FIG. 3 the bottom side 3 of the container 1 is preferably molded with an outer edge 25 extending outwardly and in a perpendicular direction relative to the imaginary horizontal axis of the recess 10. A bottom plate 26 having a shape and size substantially the same as the bottom opening of the container 1 is provided. Along the perimeter 28 of the plate 26, an upright curb 29 is provided having a top edge 30 molded in an outwardly direction relative to the bottom side 25 of the dispenser 10. This design enables the back plate 26 to be press fitted into the bottom side of the container 1 to a depth determined by the extending edge 30 of the plate 26. Additionally, an opening 32 may be provided in a corner of the plate 26 facilitating finger removal of the back plate 26 from the container 1.

The outer edge 30 of the plate 26 further provides an extension which is accommodated in a groove 33 of a back panel 34. By this means, the back panel 34 may be removably attached to the dispenser 10 to both hold the back plate 26 in position and provide a surface for an adhering means 35. Examples of adhering means 35 which may be used include Velcro® brand material, brackets, adhesive strips, or any other means known in the art. The dispenser 10 may be mounted to either a wall or on a flat surface, such as a table.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

We claim:

1. A dispenser housing a plurality of pre-moistened towelettes comprising:

(a) a container having a bottom, a top, and a means to separate said bottom and said top to provide a space, said container also having a cavity having a base wall and peripheral walls, said peripheral walls extending from said base wall to said top of said container and said base wall having an opening transversely positioned relative to a presented edge of one of a plurality of disposable interfolded pre-moistened towelettes removably positioned in said space of said container whereby access is provided from said cavity through said opening to said towelettes allowing removal of a towelette from said cavity in said container such that upon removal of said towelette from said container the next succeeding towelette extends from said space through said opening such that the presented edge of said towelette is located in said cavity and is readily available for subsequent removal from said cavity;

(b) a lid in the form of a sheet adapted to cover said cavity and having a secured edge attached to the top of said container in such a manner that said entire lid is spaced from said base wall of said cavity, said lid having an unsecured edge diametrically opposite said secured lid; and (c) closure means within said cavity for interference holding of said unsecured edge of said lid in a manner such that said entire lid fits into said cavity and is spaced from said base wall of said cavity.

2. The dispenser according to claim 1, wherein said closure means comprises:

a recessed ledge positioned within said cavity and extending into said cavity, said recessed ledge attached to said secured edge of said lid; and a riser wall extending from said ledge to said top of said container in a substantially perpendicular direction and in such a manner for interference holding of said unsecured edge of said resilient lid by means of press fitting within said cavity.

3. A dispenser according to claim 2, wherein said pre-moistened towelettes are contained within a flexible package.

4. A dispenser according to claim 3, wherein said lid comprises a tab attached to said unsecured edge.

5. A dispenser according to claim 4, wherein a thumb-like impression is positioned in said top and extends through said riser wall flush with said ledge, said impression being of sufficient dimension to accommodate said tab of said unsecured lid edge.

6. A dispenser according to claim 5, wherein said bottom of said container is removably attached and forms a part of said container.

7. A dispenser according to claim 6, wherein said bottom further comprises an opening therethrough, facilitating removal of said bottom from said container.

8. A dispenser according to claim 7, wherein said dispenser further comprises an attachment means removably secured to said bottom of said container for attaching the dispenser to a flat surface.

9. A dispenser according to claim 8, wherein said attachment means comprises an attachment panel having a bottom side away from the dispenser and accommodating an adhesive material.

* * * * *

UNITED STATES PATENT AND TRADEMARK OFFICE

CERTIFICATE OF CORRECTION

PATENT NO. : 4,735,317

DATED : April 5, 1988

INVENTOR(S) : Charles M. Sussman and William T. McTiernan

It is certified that error appears in the above-identified patent and that said Letters Patent is hereby corrected as shown below:

At the cover page of the patent, the correct "Assignee" is and should read:

--IFC Nonwovens, Inc., Jackson, Tenn.--

Signed and Sealed this

Twenty-seventh Day of September, 1988

*Attest:*

DONALD J. QUIGG

*Attesting Officer*

*Commissioner of Patents and Trademarks*